United States Patent [19]

Fischer

[11] Patent Number: 4,900,881

[45] Date of Patent: Feb. 13, 1990

[54] SAFETY INTERLOCK FOR FLOOR MAINTENANCE MACHINE AND METHOD

[75] Inventor: Ernest J. Fischer, Skokie, Ill.

[73] Assignee: Breuer Electric Mfg. Co., Chicago, Ill.

[21] Appl. No.: 261,726

[22] Filed: Oct. 24, 1988

[51] Int. Cl.[4] ..... A47L 11/14; H01H 3/20; H01H 9/06

[52] U.S. Cl. ..... 200/61.85; 15/49 R; 15/DIG. 10; 200/332.2; 200/321

[58] Field of Search ..... 15/49 R, 50, 98, 319, 15/DIG. 10; 200/18, 50 R, 61.85, 320, 321, 334, 322

[56] References Cited

U.S. PATENT DOCUMENTS

| | | | |
|---|---|---|---|
| 2,919,332 | 12/1959 | Descarries | 200/332.2 |
| 3,411,170 | 11/1968 | Kingsley | 15/50 R |
| 3,798,697 | 3/1974 | Lowder et al. | 15/49 R |
| 4,174,473 | 11/1979 | Brenneman | 200/61.85 X |
| 4,198,721 | 4/1980 | Copeland | 200/61.85 X |
| 4,435,870 | 3/1984 | Tucker et al. | 15/49 R X |
| 4,542,551 | 9/1985 | Phillips | 15/49 R |

*Primary Examiner*—J. R. Scott

*Attorney, Agent, or Firm*—Juettner Pyle Lloyd & Verbeck

[57] ABSTRACT

A floor maintenance machine has a base, an electric motor on the base for moving a floor treating element and a handle connected to the base. Carried by the handle are an electric switch for connecting electric power to the motor, a pair of manually movable hand levers for controlling actuation of the switch, and a safety latch and an interlock mechanism for preventing and enabling movement of the hand levers to actuate the switch. The safety latch normally blocks movement of the hand levers from off to on positions to actuate the switch, but may be manually moved to a release position out of blocking relationship with the hand levers. When the safety latch is in its release position, movement of the hand levers from their off to their on positions is then controlled by the interlock mechanism, which enables both hand levers to be simultaneously moved from their off to their on positions to actuate the switch and energize the motor, but prevents only one hand lever from being moved from its off to its on position while the other hand lever is in its off position. Once both hand levers have been simultaneously moved to their on positions, only one hand lever then needs to be held in its on position to continue to energize the motor. By virtue of the interlock mechanism, both hands of an operator must be on the machine to start it.

15 Claims, 4 Drawing Sheets

SAFETY INTERLOCK FOR FLOOR MAINTENANCE MACHINE AND METHOD

BACKGROUND OF THE INVENTION

The present invention relates to floor maintenance machines in general, and in particular to a safety interlock for controlling start up of a floor maintenance machine of a type having a rotatable floor treating pad or brush.

A floor maintenance machine of a type having a rotatable floor treating element, such as a pad or brush, and a motor positioned over the element, can be a potentially dangerous piece of equipment, particularly when operated by an untrained or careless user. since the weight of the motor is directly over the element and only the element touches the floor during operation, the machine handle attempts to rotate when held, and has a reaction torque equal to that imposed by the spinning element. If the handle is held so that the element sits squarely on the floor, when the machine is operating it can be balanced and held stationary with very little effort. However, if the machine is started from rest without securely holding onto the handle, the handle will whip around the element and motor and injury to an operator can occur.

In an effort to eliminate or at least minimize handle reaction torque, machines have been designed that do not have the motor over the floor treating element. However, a disadvantage is that the design comprises the function and utility of the machine, since it does not permit the machine to perform as efficiently as one in which the motor is over the element.

To avoid sacrificing performance, most efforts to make floor maintenance machines safer have been directed to using a separate safety device, which usually is a button or lever that must be depressed or moved to free a hand lever to be squeezed to start the machine. The approach eliminates accidental start up, since brushing up against or bumping the hand lever will not cause the machine to start. Rather, before it can be started a deliberate action is required, i.e., releasing the safety sevice.

Unfortunately, such conventionally employed safety devices address only one safety aspect. They prevent accidental start up of the machine, but they do not protect the untrained or careless user upon start up. The problem arises because almost all floor maintenance machines have dual hand levers, and can be started up and operated using either the right or the left hand. This is done to prevent fatigue, allow for line cord movement, permit spraying a cleaner on the floor, etc. Because of this, conventional safety devices are designed so that they must be operated by the hand not on a hand lever, or by the hand on a hand lever while the other hand is not on the other hand lever. Either condition can be dangerous, since the high reaction torque upon machine start up can pull the machine handle out of the user's one hand.

OBJECTS OF THE INVENTION

An object of the present invention is to provide a safety interlock for a floor maintenance machine, which permits the machine to be started from rest only when both hand levers of a pair are simultaneously squeezed.

Another object is to provide such a safety interlock which, after start up of the machine, enables the machine to continue to be operated with only one hand lever being squeezed.

SUMMARY OF THE INVENTION

In accordance with the present invention, a floor maintenance machine having a floor treating element, an electric motor for moving the element, electric switch means for controlling connection of electric power to the motor, and a pair of hand levers for controlling operation of the switch means, includes interlock means for controlling movement of the hand levers. The interlock means enables the hand levers to be simultaneously moved from deactuated to actuated positions to operate the switch means to connect electric power to the motor, but inhibits movement of just one hand lever from its deactuated to its actuated position, while the other hand lever remains in its deactuated position, to thereby prevent the switch means from being operated to connect power to the motor.

In a preferred embodiment, the interlock means, after the hand levers are simultaneously moved from their deactuated to their actuated positions, enables the switch means to continue to be operated to connect power to the motor with just one hand lever in its actuated position.

The invention also contemplates a method of controlling start up of an electrically powered floor maintenance machine having a pair of hand levers that are squeezable by an operator to energize an electric motor of the machine. The method comprises the steps of energizing the electric motor to start the machine upon both hand levers being simultaneously squeezed; and preventing energization of the electric motor to start the machine upon just one hand lever being squeezed while the other is not.

In a preferred practice of the method, also included is the step, following energization of the electric motor upon both hand levers being simultaneously squeezed, of maintaining the electric motor energized for as long as at least one hand lever continues to be squeezed.

The foregoing and other objects, advantages and features of the invention will become apparent upon a consideration of the following detailed description, when taken in conjunction with the accompanying drawings.

BRIEF DESCRIPTION OF THE DRAWINGS

FIG. 5 is similar to FIG. 3, except that the safety latch and interlock are shown in their condition when the machine is on.

DETAILED DESCRIPTION

Figure 1:
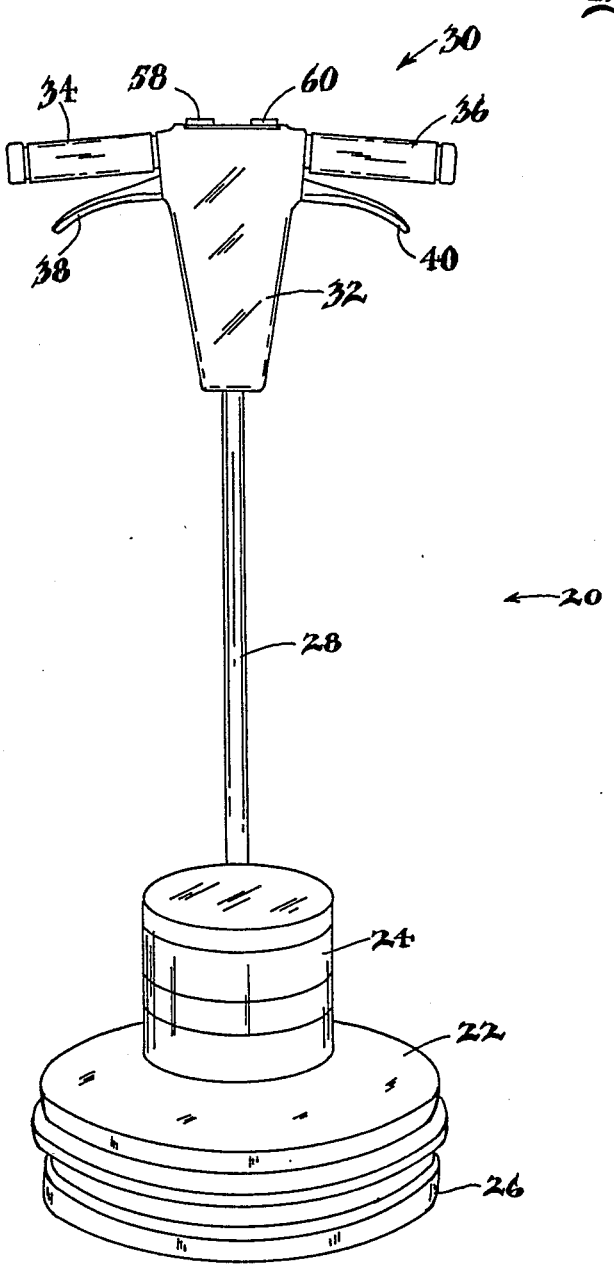
FIG. 1 is a perspective view of a floor maintenance machine of a type with which the interlock mechanism of the present invention may advantageously be used.

FIG. 1 illustrates a floor maintenance machine, indicated generally at 20, of a type with which the teachings of the invention may advantageously be used. The machine includes a base 22 having a motor compartment 24, within which is an electric motor (not shown) having a downwardly extending output shaft connected to and for rotating a floor treating element 26 on a floor or surface to be treated. The motor is directly above the floor treating element, which may comprise a pad or brush, and the element is rotated about the axis of the motor shaft. A lower end of a tubular handle extension 28 is connected to the rear of the base, and a handle assembly, indicated generally at 30, is at an upper end of the extension.

The handle assembly 30 includes a housing 32 and a pair of hand grips 34 and 36 extending outwardly from opposite sides of the housing upper end. It also includes a pair of operator squeezable hand levers 38 and 40 associated with the hand grips, and each hand lever is pivotally mounted toward its inner end within the housing. A power cable (not shown) for connection to a source of a.c. voltage extends into the housing, and within the housing the cable connects to an electric switch for controlling connection of power to the electric motor via conductors extending between the switch and motor through the tubular handle extension 28.

A floor maintenance machine can be a potentially dangerous piece of equipment in the hands of an untrained or careless user or when accidentally activated in an upright condition. Because the weight of the motor is directly over the floor treating element 26 and only the element touches the floor during operation, the handle extension 28 and handle assembly 30 are imparted a reaction torque by the spinning floor treating element, and attempt to rotate when held. When the floor treating element sits squarely on the floor and the machine is running, the machine can be balanced and held stationary with very little effort. However, if the machine is started from rest without holding onto the handle assembly, the handle extension and assembly will whip or rapidly rotate around the element and motor and injury can occur.

Conventional efforts to eliminate the danger from handle reaction torque involve preventing accidental starting of the machine by providing a safety device that must be actuated before a hand lever can be squeezed toward a hand grip to start the machine. This approach eliminates accidental start up, since bumping or accidental squeezing a hand lever will not start the machine. Rather, a separate deliberate action is required, i.e., actuation of the safety device, before a hand lever may be moved. However, while such a safety device prevents the machine from accidentally being started, it does not fully protect a user. A floor maintenance machine is usually designed with dual hand levers, and it can be operated with just the left or right hand squeezing the hand lever only. This is done to prevent fatigue and free the other hand to move the line cord, spray cleaner on the floor, etc., and because of this feature, conventional safety devices are arranged to be operated either by the hand of the user not on a hand lever or by the hand on a hand lever. Either condition can be dangerous, since the high reaction torque upon machine start up can pull the handle out of the user's one hand.

In overcoming the disadvantages of the prior art, the invention provides a novel interlock mechanism that controls the condition under which the floor maintenance machine 20 may be started up from rest. The interlock allows the machine to be started only after a safety lever has been released and, additionally, both hand levers are simultaneously squeezed. The arrangement requires both hands of a user to be on the machine to start it, and with both hands gripping the machine, even untrained users are unlikely to lose their grip on the handle due to reaction torque. The machine may still be difficult to control upon start up, but with both hands of a user on the handle, the danger from handle whip is preventable. After the machine has been started and is easier to control, it may then be operated with either one or both hands, i.e., by squeezing just one or both of the hand levers.

Figure 2:
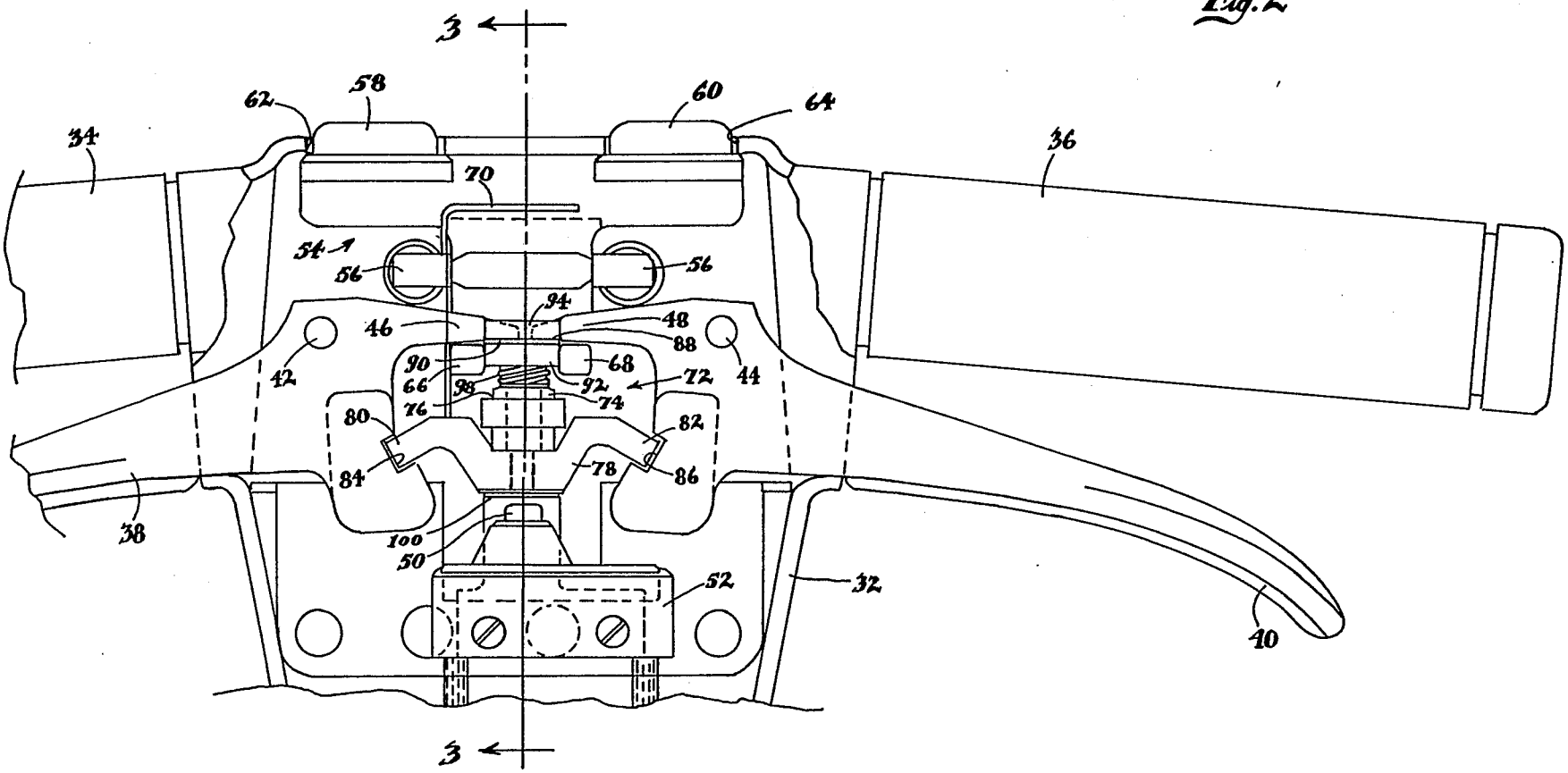
FIG. 2 is a fragmentary front view of the interlock.
Figure 3:
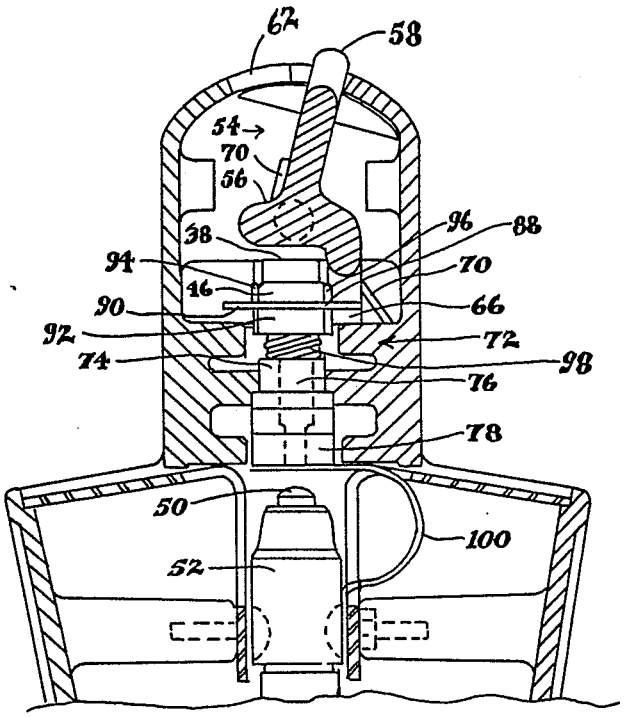
FIG. 3 is a cross sectional side elevation view of the interlock, taken substantially along the lines 3—3 of FIG. 2 showing a safety latch and the interlock in their condition when the machine is off.
Figure 4:
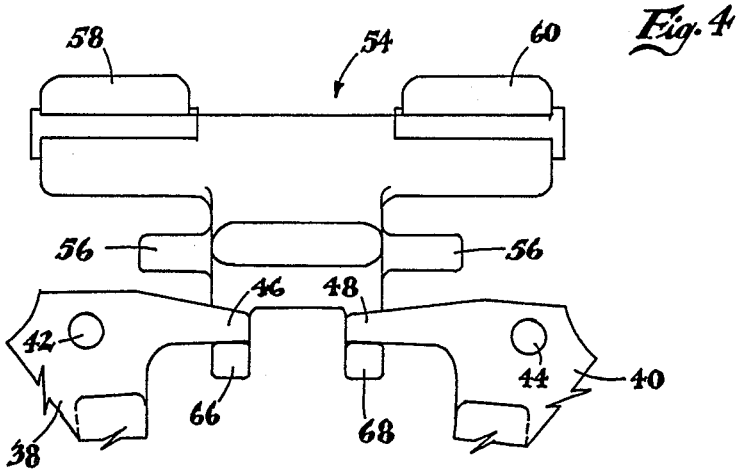
FIG. 4 shows further details of the safety latch of the machine.

Referring to FIGS. 2 and 3, the hand levers 38 and 40 pivotally mount within the housing 32 on pivot pins 42 and 44. The levers have respective inwardly extending fingers 46 and 48, and are squeezable by a user toward their associated hand grips 34 and 36 to cause an actuator 50 of an electric switch 52 to be depressed to connect the a.c. voltage to and energize the electric motor. To prevent accidental start up of the machine 20, before the hand levers may be moved toward the hand grips a safety latch, indicated generally at 54, must first be actuated. The safety latch, as also shown in FIG. 4 may be an integrally formed member and includes a pair of pivot pins 56, by means of which it is pivotally mounted within the housing. At an upper end of the latch are a pair of extensions 58 and 60, each toward an associated one of the hand grips. The extensions pass through respective slots 62 and 64 in the housing, and the slots are elongate in the front to back direction to accommodate movement of the extensions forwardly and rearwardly. Beneath its pivot pins the latch is configured to define a pair of L-shaped legs 66 and 68 that normally extend at their forward ends beneath respective hand lever fingers 46 and 48. A spring 70 is under tension between the housing and a front surface of the latch above the pivot pins to normally pivotally urge the latch in a direction that moves the extensions to the rearward ends of the slots and the L-shaped legs beneath the hand lever fingers. Consequently, with the machine at rest the L-shaped legs are beneath the hand lever fingers, so that the hand levers cannot be moved, accidentally or otherwise, toward the hand grips to start the machine. Rather, to free the hand levers for movement toward the hand grips, a user must first push one or both of the latch extensions forwardly to pivot the latch and move the L-shaped legs from beneath the fingers. The extension 58 is positioned to be pushed forwardly by the right thumb of a user and the extension 60 by the left thumb.

Since the safety latch 54 must be deliberately actuated, it protects a user aginst accidental start up of the machine. The machine is designed, however, to be operated by either the left or right hand of a user, and the latch, by itself, would not prevent a user from starting the machine by squeezing just one of the hand levers 38 and 40. Accordingly, to ensure that an operator has both hands on the machine when he starts it from rest, an interlock mechanism, indicated generally at 72, is between the hand levers and actuator 50 of the electric switch 52. The purpose of the interlock mechanism is to allow the machine to be started from rest only after the safety latch is actuated and, additionally, both hand levers are squeezed simultaneously. In consequence, both hands of the user must be on the hand grips 34 and 36 to start the machine. There will still be a reaction torque upon start up, but with both hands on the machine, the handle whip problem is preventable. Once it is running, the machine it is easier to control, and the interlock mechanism then enables it to continue to be operated by squeezing just one hand lever.

The interlock mechanism 72 includes a guide pin bushing 74 mounted on the housing 32. A guide pin 76 is longitudinally slidable within the bushing, and at its lower end threads into and carries a switch activator 78. On its opposite side the switch activator defines a pair of outwardly and downwardly extending arms 80 and 82 that are received at their ends, when the machine is at rest, within respective notches 84 and 86 in the hand levers 38 and 40.

A spring cap 88 is on the upper end of the guide pin 76. The spring cap comprises a plate 90, on a lower surface of which is an open ended cylindrical section 92 and on an upper surface of which are a pair of upright transversely extending and spaced apart walls 94 and 96. The upper end of the guide pin is received within the cylindrical section, as is the upper end of a coil spring 98 that is around the guide pin and under compression between the bushing 74 and lower surface of the plate. Inner ends of the hand lever finger 46 and 48 extend over the upper surface of the plate and between the walls into facing, spaced apart relationship. A leaf spring 100 is attached at one end to the housing 32 and extends at an opposite end beneath a lower surface of the switch activator 78 to urge the activator upwardly.

FIGS. 2 and 3 show the conditions of the safety latch 54 and interlock mechanism 72 when the machine 20 is at rest. At this time, the springs 98 and 100 are urging the interlock mechanism to its upper position, the spring 70 is pivoting the safety latch to its position placing the L-shaped legs 66 and 68 beneath and in blocking relationship to the hand lever fingers 46 and 48, and the ends of the switch activator arms 80 and 82 are in the hand lever notches 84 and 86.

To start the machine 20, one of the safety latch extensions 58 and 60 is first pushed forwardly to pivot the latch 54 and move the end of its L-shaped legs 66 and 68 from beneath the hand lever fingers 46 and 48 to free the hand levers 38 and 40 for being squeezed toward the hand grips 34 and 36. While the latch is being held in its release position, both hand levers are then squeezed simultaneously to close the switch 52 and energize the motor. Both hand levers must be squeezed simultaneously to start the machine, since only under that condition are they free to pivot and move their notches 84 and 86 away from the outer end of the switch activator arms 80 and 82, and to press down with their fingers on the spring cap 88 to push the switch activator 78 downwardly, via the guide pin 76 and against the urging of the springs 98 and 100, to depress the switch actuator 50 and close the switch. If while the safety latch is released only one hand lever is squeezed, it will not be free to pivot and it will not be possible to move the switch activator downwardly to close the switch, since under this condition an end of one of the switch activator arms 80 and 82 will be caught in the notch 84 or 86 of the hand lever not being squeezed. Consequently the user must have both hands on the machine to simultaneouly squeeze both hand levers, whereby the potential for injury due to handle reaction torque may be prevented.

Figure 5:
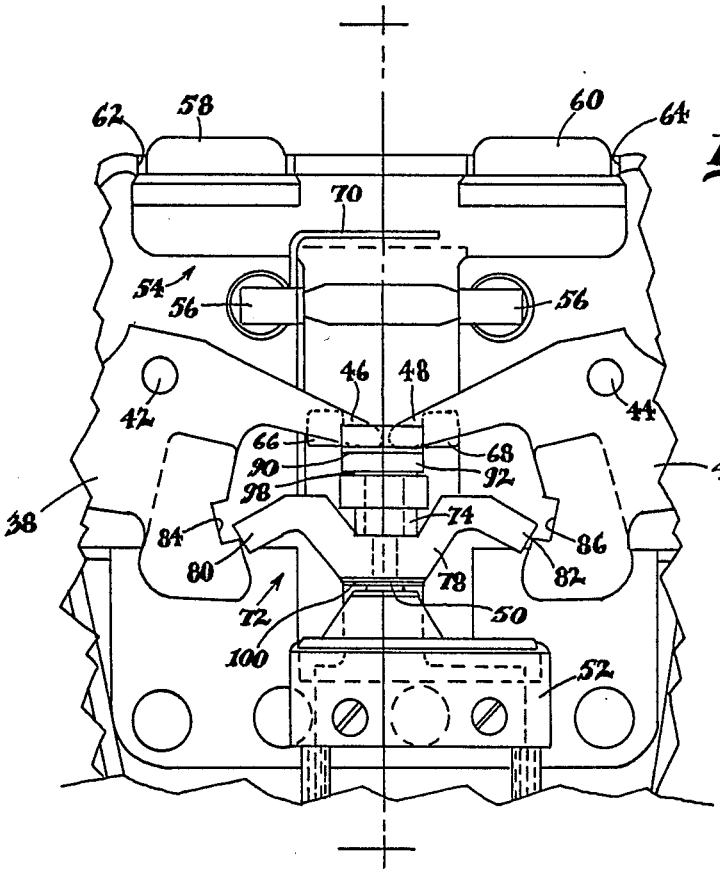

When the hand levers 38 and 40 are simultaneously squeezed to start the machine 20, their fingers 46 and 48 move downwardly to positions opposite the ends of the safety latch legs 66 and 68, so upon release of the safety latch it will be blocked from returning to its locking position. At this point, with the machine running and easier to control, one or the other of the hand levers may be released for one hand operation of the machine, with the other hand lever then continuing to hold the latch in its released position. FIG. 5 shows the condition of the safety latch 54 and interlock mechanism 72 when both hand levers 38 and 40 are squeezed and the machine 20 is started up.

When the hand levers 38 and 40 are released to stop the machine,the springs 98 and 100 return the hand levers and interlock mechanism 72 to their rest positions, at which point the safety latch 54 is pivoted by the spring 70 to again place its legs 66 and 68 beneath and in blocking relationship with the hand lever fingers 46 and 48.

While one embodiment of the invention has been described in detail, various modifications and other embodiments thereof may be desired by one skilled in the art without departing from the spirit and scope of the invention, as defined in the appended claims.

What is claimed is:

1. A method of controlling start up of an electrically powered floor maintenance machine having an electric motor for moving a floor treating element and a pair of hand levers that are squeezable by an operator, comprising the steps, each beginning with neither hand lever being squeezed, of causing energization of the electric motor upon both hand levers being simultaneously squeezed; and preventing energization of the electric motor upon only one hand lever being squeezed while the other is not squeezed.

2. A method as in claim 1, including the step, following energizing of the electric motor upon both hand levers being simultaneously squeezed, of maintaining the electric motor energized for as long as at least one hand lever is squeezed.

3. A method of controlling start up of an electrically powered floor maintenance machine having an electric motor for moving a floor treating element and a pair of hand levers that are movable between deactuated and actuated positions to control energization of the electric motor, comprising the steps of enabling both hand levers to be simultaneously moved from their deactuated to their actuated positions; causing energization of the electric motor upon both hand levers being moved to their actuated positions; while one hand lever remains in its deactuated position, inhibiting movement of the other hand lever from its deactuated to its actuated position; and preventing energization of the electric motor when both hand levers are in their deactuated positions.

4. A method as in claim 3, including the step, following said step of enabling simultaneous movement of both hand levers from their deactuated to their actuated positions, of maintaining the electric motor energized for as long as at least one hand lever is moved to its actuated position.

5. A method as in claim 3, wherein the floor maintenance machine has a safety latch that is movable between on and off positions, and including the steps of urging the safety latch to its on position when both hand levers are in their deactuated positions; preventing movement of the hand levers from their deactuated to their actuated positions when the safety latch is in its on position; moving the safety latch to its off position prior to performing the step of enabling simultaneous movement of both hand levers from their deactuated to their actuated positions; and permitting simultaneous movement of the hand levers from their deactuated to their actuated positions when the safety switch is in its off position.

6. A method of controlling start up of an electrically powered floor maintenance machine having an electric motor for moving a floor treating element and a pair of hand levers that are movable between deactuated and actuated positions to control energization of the electric motor, such that when either hand lever is moved to its actuated position the electric motor is energized, said method comprising the steps of enabling the pair of hand levers to be simultaneously moved from their deactuated to their actuated positions; causing energization of the electric motor upon both hand levers being moved to their actuated positions; whenever both hand levers are initially in their deactuated positions, preventing only one of the hand levers from being moved to its actuated position; and preventing energization of the electric motor when both hand levers are in their deactuated positions.

7. A method as in claim 6, including the step, after both hand levers have been simultaneously moved from their deactuated to their actuated positions, of maintaining the electric motor energized for as long as at least one of the hand levers is moved to its actuated position.

8. A method as in claim 6, including the steps, when the electric motor is not actuated, of mormally locking both hand levers in their deactuated positions; and, prior to simultaneous movement of the hand levers to their actuated positions, inhibiting operation of said normally locking step to free the hand levers for simultaneous movement to their actuated positions.

9. In a floor maintenance machine, an electric motor for moving a floor treating element; electric switch means operable to connect electric power to said motor; a pair of hand levers for being squeezed by an operator; and means for controlling operation of said switch means, in response to said hand levers being squeezed, to operate said switch means to connect power to said motor when said hand levers are simultaneously squeezed and to prevent operation of said switch means when, upon neither hand lever initially being squeezed, only one of said hand levers is squeezed while the other is not squeezed.

10. In a floor maintenance machine as in claim 9, wherein said controlling means, after both of said hand levers have been simultaneously squeezed, operates said switch means to continue to connect power to said motor for as long as at least one of said hand levers continues to be squeezed.

11. In a floor maintenance machine, an electric motor for moving a floor treating element; electric switch means for controlling connection of electric power to the motor; a pair of hand levers; means for coupling said hand levers to said switch means for operation of said switch means by said hand levers, said hand levers being movable between deactuated positions whereat said switch means is operated to disconnect power from the motor and actuated positions whereat said switch means is operated to connect power to the motor; and means for controlling movement of said hand levers to enable said hand levers to be simultaneously moved from their deactuated to their actuated positions to operate said switch means to connect power to the motor and to prevent movement of one hand lever only from its deactuated to its actuated position while the other hand lever is in its deactuated position to prevent said switch means from being operated to apply power to the motor.

12. In a floor maintenance machine as in claim 11, wherein said controlling means, after said hand levers have been simultaneously moved from their deactuated to their actuated positions, enables operation of said switch means for as long as at least one hand lever is moved to its actuated position, so that said switch means then continues to be operated to connect power to the motor with only one hand lever moved to its actuated position.

13. In a floor maintenance machine as in claim 11, including latch means movable between a first position, when both hand levers are in their deactuated positions, for blocking movement of said hand levers to their actuated positions, and a second position out of blocking relationship to said hand levers for pemitting said hand levers to be simultaneously moved to their actuated positions.

14. A floor maintenance machine comprising a base; an electric motor on the base for moving a floor treating element; a handle connected to the base; electric switch means, carried by the handle, for controlling connection of electric power to the motor; a pair of hand levers carried by the handle; means for coupling said hand levers to said switch means for operation of said switch means by said hand levers, said hand levers being movable by an operator between deactuated positions whereat said switchmeans does not connect power to the motor and actuated positions whereat said switch means connects power to the motor; and means coupled with said hand levers for controlling movement of said hand levers to enable said hand levers to be simultaneously moved from their deactuated to their actuated positions to operate said switch means to connect power to the motor and to prevent only one of said hand levers from being moved from its deactuated to its actuated position while the other hand lever is in its deactuated position, whereby both hand levers must be simultaneously moved to their actuated positions to connect power to said motor and start said machine.

15. Apparatus as in claim 14, wherein said controlling means, after both said hand levers have been simultaneously moved to their actuated positions, enables operation of said switch means for as long as at least one hand lever is moved to its actuated position, so that the switch means then continues to connect power to the motor with only one hand lever moved to its actuated position.

* * * * *